United States Patent [19]

Burney et al.

[11] 4,295,132

[45] Oct. 13, 1981

[54] CAPACITANCE INTRUSION DETECTION SYSTEM

[75] Inventors: Charles F. Burney; Marvin D. Laymon, both of Milpitas, Calif.

[73] Assignee: GTE Products Corporation, Stamford, Conn.

[21] Appl. No.: 172,602

[22] Filed: Jul. 28, 1980

[51] Int. Cl.[3] ..... G08B 13/26

[52] U.S. Cl. ..... 340/562; 328/5; 340/568

[58] Field of Search ..... 340/562, 568; 328/5

[56] References Cited

U.S. PATENT DOCUMENTS 3,973,208 8/1976 Diamond ..... 340/562

*Primary Examiner*—Glen A. Swann, III

*Attorney, Agent, or Firm*—John F. Lawler

[57] ABSTRACT

A capacitance intrusion detection system for use with a metal object or objects insulated from ground comprises a circuit for cyclically charging and discharging the object at a relatively low frequency, for example, less than 500 Hz, and simultaneously integrating the charge on the object to develop a DC voltage proportional to the capacitance of the object. The integrating network is AC coupled to a bandpass filter which passes signals having frequencies corresponding to changes in capacitance of the object caused by an intruder and these signals are applied to a threshold circuit for activating an alarm when an intrusion occurs. Tamper alarm circuits are provided to detect unauthorized disconnection of any portion of the protected object (decrease capacitance) or the addition of capacitance in an attempt to defeat the system.

11 Claims, 4 Drawing Figures

CAPACITANCE INTRUSION DETECTION SYSTEM

BACKGROUND OF THE INVENTION

This invention relates to intrusion detection systems and more particularly to a capacitance detection system for protection of conductive objects.

Prior capacitance detection systems generally employ some type of radio frequency oscillator having the protected object as part of the capacitance of the oscillator tank circuit and utilize changes in that circuit caused by the capacitance of an intruder to produce either a frequency shift of the oscillator or a non-oscillating condition. Various techniques are employed to detect these two conditions and to cause an alarm. A principal disadvantage of such systems is that they radiate at their operating frequency. Protected objects connected to the system function as antenna elements and thus compound the problem. Such radiation may produce interference throughout the low frequency, medium frequency and high frequency radio bands. In addition, this radiation is easy to detect by the skilled intruder.

Another disadvantage of the above system is that the design of the oscillator requires a compromise between good detection sensitivity and low false alarm rate. A low Q circuit is required for good detection sensitivity in order to produce a large frequency shift for a small capacity change whereas a stable oscillator for prevention of false alarms requires a high Q circuit. Still another disadvantage is that the sensitivity of the oscillator system is a function of the capacity load. Since the capacity change of an intruder is generally constant, as more capacity is tied to the system, its sensitivity becomes less.

This invention is directed to a capacity detection system which overcomes these problems.

OBJECTS AND SUMMARY OF THE INVENTION

A general object of the invention is the provision of a capacitance detection system that does not radiate radio frequency energy.

A further object is the provision of such a system that is self-adjusting to any capacitance load within its range.

Another object is the provision of such a system having a protection range of 100,000 pF or greater.

Still another object is the provision of such a system that provides uniform detection sensitivity throughout its protection range.

A further object is the provision of a capacitance detection system that requires no tank circuit.

Another object is the provision of such a system that is simple and inexpensive to construct.

These and other objects of the invention are achieved with a circuit which cyclically charges and discharges the protected object at a relatively low frequency to produce a DC voltage proportional to the capacitance of that object, and detects predetermined rates of change of that DC voltage to trigger an alarm indicative of an intrusion. The DC network is capacitively coupled to the filter and alarm circuitry and automatically self-balances under conditions of an increase or decrease in capacitive load of protected objects. Upper and lower threshold circuits connected to the DC output of the charging circuit provide means for monitoring and indicating changes in the total capacitance of the protected object to limit system vulnerability from attempts to defeat it either by removal of part of the protected object or by swamping the system through connection of a large external capacitance.

DESCRIPTION OF THE PREFERRED EMBODIMENTS

Figure 1:
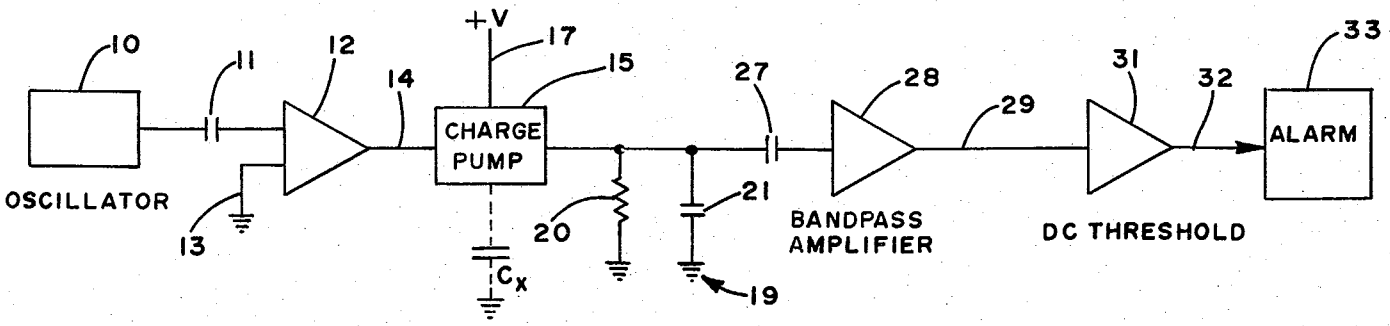
FIG. 1 is a block schematic diagram of the capacitance detection system embodying this invention.

Referring now to the drawings, FIG. 1 illustrates an embodiment of the invention comprising an oscillator 10 connected by capacitor 11 to one input of an operational amplifier 12, the other input 13 of which is connected to ground. Oscillator 10 requires only short term stability and so any standard RC oscillator may be used. The frequency of oscillator 10 preferably is less than 500 Hz and may be, for example, 30 Hz. Amplifier 12 is employed as a zero-crossing amplifier and is switched on and off at the frequency of oscillator 10 to produce a square wave output on line 14. This waveform is applied to a charge pump 15 which is connected to a voltage source V, to the protected object indicated as the capacitor $C_x$ and to an integrating network 19 consisting of resistor 20 and capacitor 21. The protected object is electrically conductive and may comprise one or more filing cabinets, desks, consoles, vehicles, aircraft, window frames, or other metal objects insulated from ground and electrically connected together to form one plate of capacitor $C_x$.

Figures 2, 3:
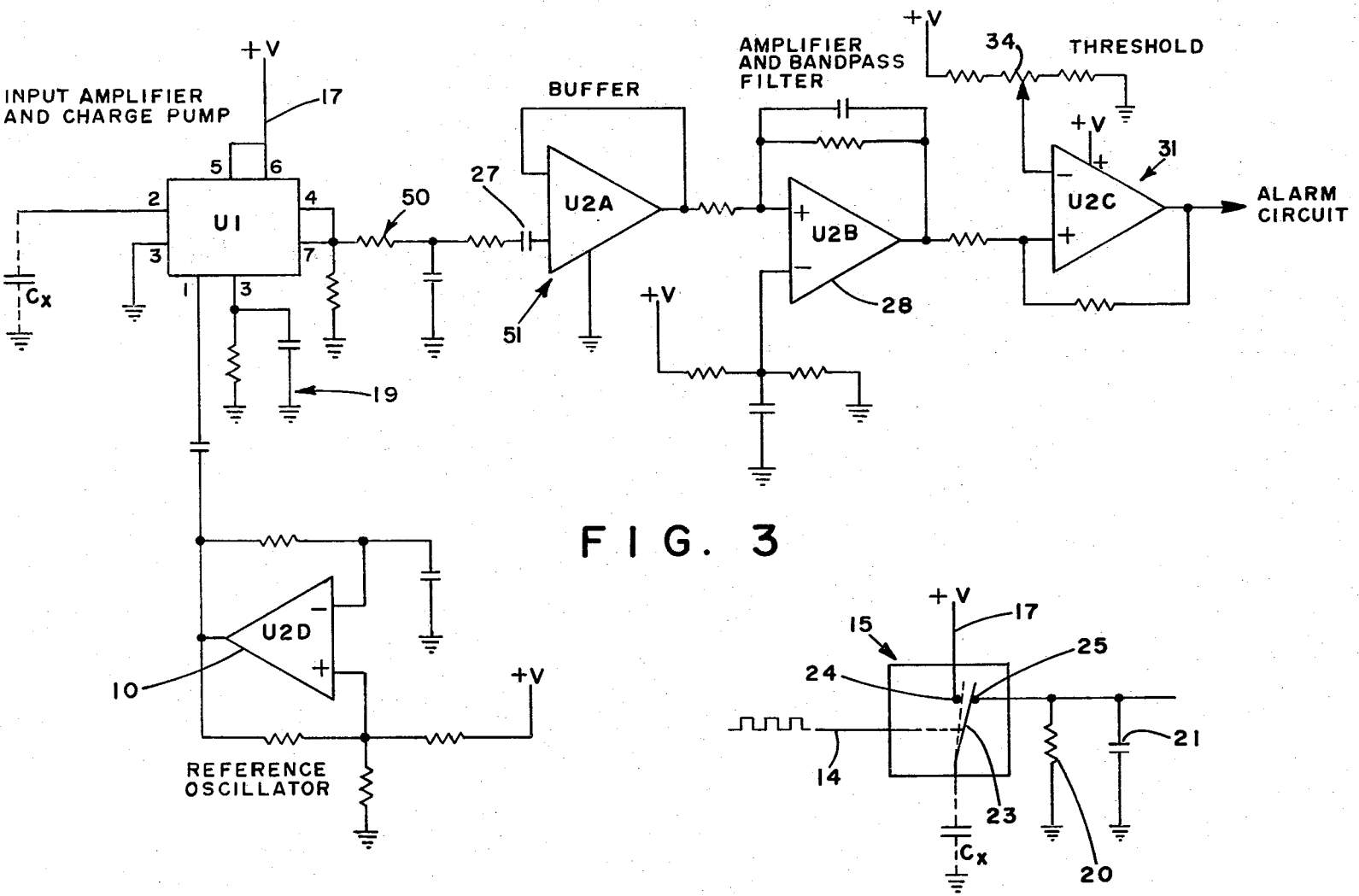
FIG. 2 is a schematic diagram of the circuit equivalent of the charge pump.
FIG. 3 is a complete circuit diagram of the system embodying the invention.

The simplified schematic diagram of FIG. 2 illustrates substantially a functional equivalent of charge pump 15 shown as a switch having a moving contact 23 and two stationary contacts 24 and 25. Moving contact 23 is connected to capacitor $C_x$ and stationary contacts 24 and 25 are connected to voltage source V via line 17 and to integrating network 19, respectively. Moving contact 23 is caused to move between the solid line position against contact 25 and the broken line position against contact 24 at the frequency of the input square wave on line 14. Capacitor $C_x$ is charged by source V when contact 23 is in the broken line position and is discharged through resistor 20 of the integrating network when contact 23 is in the solid line position. Thus the DC voltage on integrating capacitor 21 is proportional to the capacitance of $C_x$.

In practice, charge pump 15 and amplifier 12 are part of a commercially available integrated circuit produced by National Semiconductor Co., Santa Clara, Calif. and sold as Model No. LM2907N-8. A detailed explanation of the operation of this circuit is given at pages AN162-1 to 3 of the National Semiconductor handbook entitled "Linear Applications Handbook" published in 1978.

The integrating network 19 is connected by capacitor 27 to a bandpass amplifier 28 which produces an output on line 29 for signals having frequencies within the band of interest, for example, 0.03–10 Hz. Capacitance changes caused by intruders fall within this band. The gain of amplifier 28 is selected to provide the sensitivity required for optimum detection capability. The output of amplifier 28 on line 29 is applied to a DC threshold amplifier 31 connected by line 32 to suitable alarm circuits 33 for energizing a bell, light or other indicator.

The DC voltage on capacitor 21 is a linear function of the capacity of the protected object $C_x$. The sensitivity of the circuit is determined by the voltage of source V applied to charge pump 15 and the maximum size of $C_x$. For example, with an applied voltage of 12 volts, the maximum output of charge pump 15 is 10.5 volts. Assuming the maximum capacitance of $C_x$ to be 1,000 pF, the sensitivity would then be 10.5/1000, or 10.5 mV per pF. For a $C_x$ of 100,000 pF, the sensitivity would be 0.1 mV per pF. It is thus only necessary to determine the maximum capacity of $C_x$ that is required and to provide the amplification necessary in amplifier 28 to detect the capacity change caused by an intruder. For example, the average intrusion capacity change for a human being has been measured as approximately 200 pF. Assuming a workable threshold detector operates at a 1.0 volt threshold, a $C_x$ of 100,000 pF would require an amplification factor of 50 to reach the 1 volt threshold.

The operation of the circuit will now be described. Oscillator 10 causes zero-crossing amplifier 12 to produce a square wave on line 14 which is applied to charge pump 15 for controlling the rate of charging capacitor $C_x$. Network 19 integrates the charge on capacitor $C_x$ and develops a DC voltage on capacitor 21 that is proportional to the capacitance of capacitor $C_x$. This DC voltage is blocked from the rest of the circuit by coupling capacitor 27.

Changes in capacitance of capacitor $C_x$ caused by an intruder are coupled by capacitor 27 to bandpass amplifier 28 with a passband selected to transmit such signals to the threshold and alarm circuit. Changes in the capacitance of $C_x$ due to environmental changes or oscillator drift, however, are not transmitted to the alarm circuits and the DC circuit simply balances itself to the new capacity load caused by these changes. The same is true for changes in the number or size of protected objects which increase or decrease the load capacity $C_x$. Thus a system designed to operate against a maximum $C_x$ capacity of 100,000 pF will also work with a $C_x$ capacity of 100 pF. The conversion of the capacitance $C_x$ into a proportional DC voltage together with the AC coupling of that voltage to the AC amplifier and alarm circuitry permits the system to accommodate such a wide range of capacitance loads. Only changes in capacitance at a rate corresponding to those of a human intruder approaching or touching the protected object are transmitted by amplifier 28 to the threshold and alarm circuits.

A complete circuit diagram of the system embodying the invention is shown in FIG. 3 wherein like parts are indicated by like reference characters. Integrated circuit U1 denotes National Semiconductor's Model LM2907-8 and U2A, U2B, U2C and U2D are contained on a single chip Model LM324, also made by this corporation. A ripple filter 50 smooths the output of the charge pump and voltage follower buffer 51 between capacitor 27 and amplifier 28 provides additional isolation between the DC and AC circuits. Potentiometer 34 permits adjustment of the threshold level of the detector for additional control of sensitivity.

Capacitance detection systems of the type to which this invention is related generally have two areas of vulnerability. They generally occur when the system is turned off and consist of (1) disconnection of the protected object from the system and (2) "swamping" the system by connecting a large external capacitance across the protected object to ground.

Figure 4:
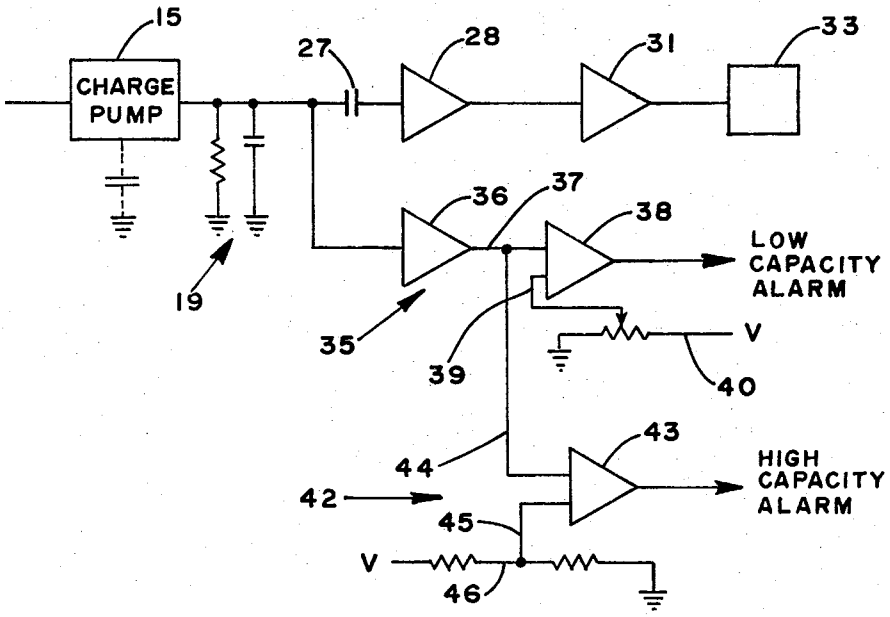
FIG. 4 is a schematic diagram showing upper and lower threshold circuits connected to the main circuit.

In accordance with this invention, these problems are overcome in the following manner. To prevent objects from being disconnected from the protected system, a separate adjustable threshold circuit 35, see FIG. 4, is connected to the output of integrating circuit 19. Circuit 35 comprises an amplifier 36, the output 37 of which is applied as one input to a comparator 38. The other input 39 to comparator 38 is connected to a potentiometer 40 connected between a DC voltage source V and ground. This potentiometer provides an adjustable threshold voltage which when exceeded by the DC output of amplifier 36 produces an output to energize a low capacity alarm, i.e., an alarm which indicates that the capacity of the protected object or system has been decreased.

At the time of installation with all objects connected to the detection circuit, the threshold circuit 35 is adjusted for a "non-alarm" condition. Since this threshold is connected to the DC level of the integrating circuit 19 representing the value of $C_x$, and is adjusted for a "non-alarm" condition by the reference voltage from potentiometer 40, it in effect has a memory. If the system is now turned off and an object is disconnected from it, upon reactivation of the system the lower threshold circuit instantly causes an alarm since the DC voltage produced by the capacitance $C_x$ has decreased. In practice, this threshold value is set to detect the removal of the smallest capacity object connected to the system.

In order to detect the connection of a large capacity from a protected object or system to ground, a simple fixed upper threshold circuit 42 shown in FIG. 4 is provided. Circuit 42 comprises a comparator 43 having one input 44 connected to the output of amplifier 36 and the other input 45 connected to a voltage divider 46 between the voltage source V and ground. If additional capacitance is added to the system, the DC voltage at integrating circuit 19 decreases, thereby lowering the input from line 44 to comparator 43 and producing an output from comparator 43 to energize high capacity alarm circuits.

The foregoing description of types of objects protectable by this invention is given by way of example and not of limitation. Any object that has a characteristic capacitance may be so protected. Furthermore, since the system detects small to large changes in capacitance of the object, the purpose of detecting such changes is not limited to conditions of unauthorized intrusion but may extend to other conditions of interest which produce similar changes in capacitance.

What is claimed is:

1. An intrusion detection system for an object having a capacitance comprising a charge pump having an input and an output, a voltage source connected to said input, said object being connected to said output of the charge pump, means to cyclically switch said charge pump between first and second states whereby alternately to connect and disconnect said voltage source and said object for successively charging the latter, storage means connected to said charge pump for producing a DC voltage proportional to the charge on said object, bandpass filter means having a low cutoff frequency $f_1$ and a high cutoff frequency $f_2$, capacitor means interconnecting said storage means and said filter means whereby changes in the capacitance of said object at a rate between $f_1$ and $f_2$ produce an output from said filter means, and means responsive to the output of said filter means for producing an alarm.

2. The system according to claim 1 in which said cyclic switching means comprises an oscillator having a frequency less than 500 Hz.

3. The system according to claim 1 with first tamper means responsivle to the DC voltage of said storage means for producing an output when the charge on said object is less than a predetermined threshold, and first alarm means responsive to the output of said tamper means to indicate such object charge state.

4. The system according to claim 3 with means for adjusting the value of said threshold whereby to accommodate protected objects having different capacitances.

5. The system according to claim 1 with second tamper means responsive to the DC voltage of said storage means for producing an output when the charge on said object is greater than a predetermined threshold, and second alarm means responsive to the output of said second tamper means to indicate such object charge state.

6. The system according to claim 5 in which said second tamper means comprises a source of a fixed DC voltage slightly greater than the DC voltage of said storage means, and means to compare said fixed voltage and said storage means voltage for producing an output when the latter exceeds the former.

7. A system for detecting changes in capacitance of an object comprising means for cyclically charging and discharging said object, means responsive to the charging of said object for producing a DC voltage proportional to the capacitance of said object, means for detecting the rate of change of said DC voltage, means for passing outputs from said detecting means within a predetermined frequency band and for blocking all other outputs therefrom, and means responsive to said passed outputs for indicating an alarm.

8. The system according to claim 7 in which the frequency of said charging means is less than 500 Hz.

9. The system according to claim 8 in which said frequency is 30 Hz.

10. The system according to claim 7 in which said predetermined frequency band is 0.03 to 10 Hz.

11. The system according to claim 7 with means for detecting changes in the amplitude of said DC voltage above and below predetermined threshold levels, and tamper alarm means responsive to said detected amplitude changes for indicating a tamper condition.

* * * * *